US006162032A

United States Patent [19]

Jäger

[11] Patent Number: 6,162,032

[45] Date of Patent: Dec. 19, 2000

[54] ELASTOMERIC STATOR FOR ECCENTRIC SPIRAL PUMPS

[75] Inventor: Sebastian Jäger, Hannover, Germany

[73] Assignee: ARTEMIS Kautschuk- und Kunststofftechnik GmbH & Cie, Germany

[21] Appl. No.: 09/244,817

[22] Filed: Feb. 4, 1999

[30] Foreign Application Priority Data

Feb. 4, 1998 [DE] Germany ..... 198 04 259

[51] Int. Cl.[7] ..... F04C 2/00; F04C 5/00

[52] U.S. Cl. ..... 418/48; 418/153; 29/888.022; 29/888.023; 29/888.021

[58] Field of Search ..... 418/48, 153; 29/888.022, 29/888.023, 888.021

[56] References Cited

U.S. PATENT DOCUMENTS

| | | | |
|---|---|---|---|
| 3,354,537 | 11/1967 | O'Connor | 418/48 |
| 3,642,307 | 2/1972 | Brickhouse et al. | 285/38 |
| 4,991,292 | 2/1991 | Bostel | 29/888.023 |
| 5,145,343 | 9/1992 | Belcher | 418/48 |
| 5,318,416 | 6/1994 | Hantschk et al. | 418/48 |
| 5,405,113 | 4/1995 | Jaw | 248/229 |

FOREIGN PATENT DOCUMENTS

| | | | |
|---|---|---|---|
| 2 313 261 | 9/1974 | Germany . | |
| 1959448B | 5/1978 | Germany | 418/48 |
| 2713468A | 9/1978 | Germany | 418/48 |
| 004111166A | 11/1992 | Germany | 418/48 |
| 3410306 | 11/1992 | Germany | 418/48 |

*Primary Examiner*—Thomas Denion
*Assistant Examiner*—Thai-Ba Trieu
*Attorney, Agent, or Firm*—Robert W. Becker & Associates

[57] ABSTRACT

An elastomeric stator for an eccentric spiral pump is provided. The stator has a lining that is made of elastomeric material and has a hollow chamber that serves for accommodating a rotor. The hollow chamber has a double or multiple spiral configuration. A rigid casing surrounds the lining and both the casing and the lining have an essentially uniform thickness over their length. The casing is spiraled in conformity with an inner contour of the hollow chamber. A respective flange ring is secured at each end of the casing for resting against other pump parts. The flange rings are detachably connected to other pump parts without the use of tie rods.

12 Claims, 1 Drawing Sheet

ELASTOMERIC STATOR FOR ECCENTRIC SPIRAL PUMPS

BACKGROUND OF THE INVENTION

The present invention relates to an elastomeric stator for eccentric spiral pumps and has a rigid casing that surrounds a lining that is made of rubber or the like and has a hollow chamber that serves for accommodating a rotor and has a double or multiple spiral configuration; a flange ring is disposed at the two ends of the stator for resting against other parts of the eccentric spiral pump.

With the known stators of this type, the outer periphery of the stator has a cylindrical configuration and its ends are bent away upwardly in order to be able to establish a connection to the other parts of the eccentric spiral pump. The connecting elements thus have a circular configuration on the outer and inner periphery. In addition, as a result of a cylindrical rotor casing and the spiraling within the stator, a quantity of rubber is needed, which additionally leads to varying thicknesses of the rubber.

It is therefore an object of the present invention to eliminate extra elastomeric material and to ensure uniform thicknesses of the rubber as well as favorable connection possibilities for the stator within the pump.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
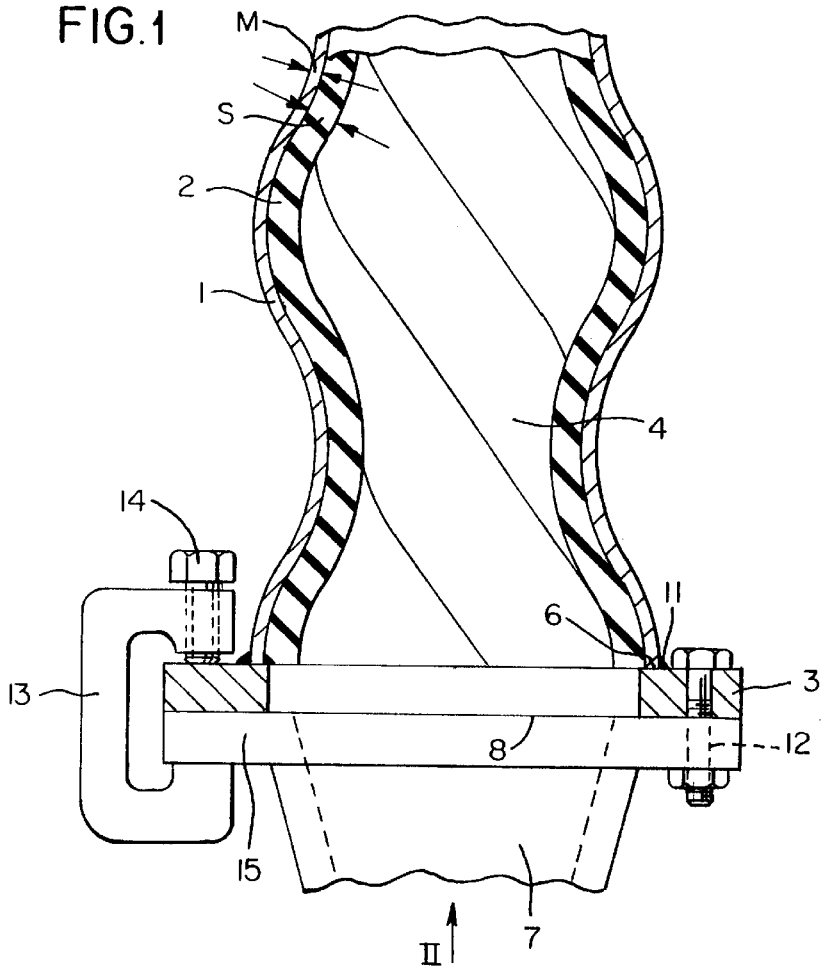
FIG. 1 is a longitudinal cross-sectional view, and in particular in the installed state, of that end portion of one exemplary embodiment of the inventive elastomeric stator that is on the pressure side and is connected to a pressure connection of a pump.

The inventive elastomeric stator is characterized primarily in that the casing, which has essentially a uniform thickness over its length, is spiraled in conformity with the inner contour of the hollow chamber of the stator, in that the lining also has an essentially uniform thickness over the length of the stator, and in that the flange rings, which are secured to the ends of the casing, are detachably connected to the remaining parts (pressure and intake connections) of the eccentric spiral pump without the use of tie rods for interconnecting the other parts of the eccentric spiral pump. In this connection, the inner periphery of the two flange rings is expediently formed to conform to the contour of the hollow chamber of the stator.

Thus, the casing of the stator is spiraled in conformity with the inner contour of the stator. The casing, as well as the lining, have practically a uniform thickness over the length of the stator. The intake and pressure side elements of the pump jack are fixedly yet detachably connected with the casing of the stator via the flange rings that are secured to the ends of the stator. In particular, this is effected in such a way that tie rods, which with conventional eccentric spiral pumps interconnect the aforementioned elements, are eliminated.

Thus, with the inventive stator the forces, especially tension forces, which result during operation of the pump, are transmitted by the spiraled casing of the stator.

Further specific features of the present invention will be described in detail subsequently.

DESCRIPTION OF PREFERRED EMBODIMENTS

Referring now to the drawing in detail, the elastomeric stator essentially comprises a rigid, for example steel, casing 1 that surrounds an inwardly disposed lining 2 that is made of rubber or rubber-like polymeric material. Disposed at the ends of the stator are flange rings 3, which are also made of steel.

Figure 2:
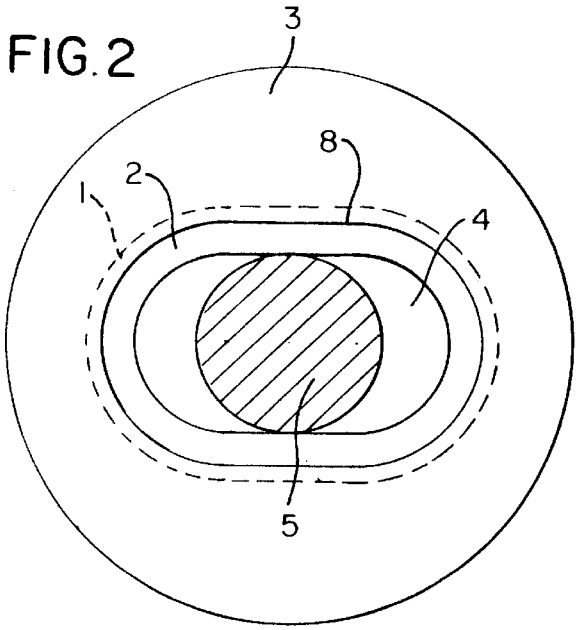
FIG. 2 is a view of the stator of FIG. 1 detached from its pressure connection, with this view being taken in the direction of the arrow 11 in FIG. 1.

The lining 2 is preferably fixedly connected to the casing 1; however, dispensing with a binder, it can also merely rest against the inner side of the casing 1 and thus be held only in a positively engaging or interlocking manner. The lining 2 has a continuous hollow chamber 4 for accommodating a rotor 5, which is merely illustrated in cross-section in FIG. 2. To achieve a pump effect the rotor 5 has the configuration of a single spiral, whereas the hollow chamber 4 has the configuration of a double spiral.

The important thing is that the lining 2 on the whole has a uniform thickness "s", and the casing 1 also has a spiral configuration on the inside and the outside in conformity with the contour of the hollow chamber 4. The casing 1 thus also has a uniform thickness M over the length of the stator.

Figure 3:
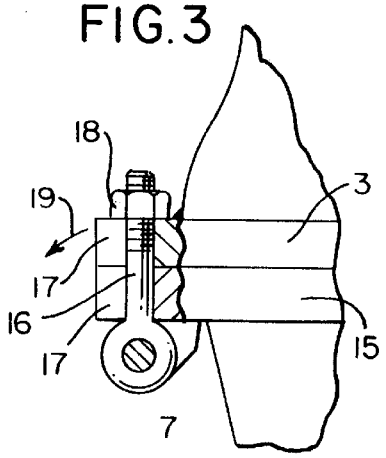
FIG. 3 is a partial side view of a connection location between the pressure side end portion of a stator and the pertaining pressure connection of the pump.

Disposed at the end face 6 of the casing 1 is a flange ring 3 that is made of steel or the like; this flange ring is intended to establish the connection between the stator on the one hand and the pump jack on the intake or pressure side on the other hand. A pressure connection 7 is illustrated in FIGS. 1 and 3.

The outer periphery of the flange ring 3 has a cylindrical configuration. However, the inwardly disposed edge 8 of the flange ring 3 extends in the manner of the contour of the hollow chamber 4, i.e. parallel thereto, and thus essentially describes an ellipse. The lining 2 projects radially inwardly relative to the edge 8.

The casing 1, already equipped with the lining 2, can be produced by being cut to length from a body of greater length by being cut therefrom or by any other suitable means. This casing 1 can then be provided at both ends with a flange ring 3 that is secured by weld joints 11 that are applied from the outside in order to form a sealed and secure connection between the casing 1 and the two flange rings 3.

The important thing is that the flange rings 3 that are disposed at the ends of the stator can now be securely yet detachably connected with the adjoining parts of the pump. In the embodiment illustrated in FIG. 1, a screw bolt connection 12 is indicated at the bottom; of course, the necessary holes must be provided in the flange. However, this connection can also be replaced by screw or C clamps 13 (see the top of FIG. 1), the screw of which is indicated by the reference numeral 14; the clamp 13 spans the rims of the two flanges 3 and 15. Another advantageous connection is the detachable connection illustrated in FIG. 3. In this embodiment, a screw bolt 16 is pivotably mounted on the flange 15. In the operating position shown in FIG. 3, the screw bolt 16 is disposed in recesses 17 that are open at the rim and are found on both flanges 3, 15. To disengage the connection, the nut 18 is loosened and the screw bolt 16 is pivoted in the direction of the arrow 19 so that the flanges 3, 15 can be freed from one another.

It should be noted that the end faces of the lining 2 and the casing 1 are preferably disposed in a plane that is perpendicular to the axis of the stator, i.e. are flush with one another. However, for flow reasons the flange ring 3 can widen conically outwardly.

The specification incorporates by reference the disclosure of German priority document 198 04 259.0 of Feb., 4, 1998.

The present invention is, of course, in no way restricted to the specific disclosure of the specification and drawing, but also encompasses any modifications within the scope of the appended

What I claim is:

1. An elastomeric stator for an eccentric spiral pump, comprising:

a lining made of elastomeric material and having a hollow chamber that serves for accommodating a rotor, wherein said hollow chamber has a double or multiple spiral configuration, and wherein said lining has an essentially uniform thickness over the length of said lining;

a rigid casing that surrounds said lining, wherein said casing has an essentially uniform thickness over the length of said casing, and wherein said casing is spiraled in conformity with an inner contour of said hollow chamber of said lining;

a respective flange ring secured at each of opposite ends of said casing for resting against other pump parts; and means for detachably connecting said flange rings to said other pump parts without having to use tie rods to interconnect such other parts.

2. A stator according to claim 1, wherein an inner peripheral surface of each of said flange rings is formed in conformity with the contour of said hollow chamber of said lining.

3. A stator according to claim 2, wherein the inner opening enclosed by said flange ring essentially has the shape of an ellipse.

4. A stator according to claim 1, wherein an outer periphery of said flange ring has an at least approximately circular shape.

5. A stator according to claim 1, wherein an inner periphery of said flange ring extends essentially parallel to the contour of said hollow chamber of said lining.

6. A method of manufacturing elastomeric stators according to claim 1, which includes the steps of producing said casing of said stator by cutting it to length from a casing body of greater length, and then providing said cut to length casing with said flange rings.

7. A method according to claim 6, wherein said stator casing is cut to length from a casing body that is provided with an elastomeric lining.

8. A stator according to claim 1, wherein an inner periphery of said flange ring widens conically in an outward direction.

9. A stator according to claim 1, wherein an end face of said lining and an end face of said casing are disposed in a plane that extends perpendicular to a central longitudinal axis of said stator.

10. A stator according to claim 1, wherein said means for detachably connecting said flange ring and said other pump parts are screw bolts that extend through these components.

11. A stator according to claim 1, wherein said means for detachably connecting said flange ring and said other pump parts is a detachable clamp that externally spans at least parts of these components.

12. A stator according to claim 1, wherein said means for detachably connecting said flange ring and said other pump parts comprises a pivotable screw bolt that in an operative position is disposed in outwardly open recesses of said flange ring and of said pump parts.

* * * * *